US006796805B2

(12) United States Patent
Murr

(10) Patent No.: US 6,796,805 B2
(45) Date of Patent: Sep. 28, 2004

(54) SURFACE MOUNT TECHNOLOGY LAND GRID ARRAY SOCKET

(75) Inventor: Keith McQuilken Murr, Etters, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/212,414

(22) Filed: Aug. 5, 2002

(65) Prior Publication Data

US 2004/0023543 A1 Feb. 5, 2004

(51) Int. Cl.[7] ..... H01R 12/00
(52) U.S. Cl. ..... 439/71
(58) Field of Search ..... 439/68–73, 65, 439/66, 330, 331, 91, 591, 83, 940, 342, 74; 324/754, 755, 758, 761, 765

(56) References Cited

U.S. PATENT DOCUMENTS 5,772,451 A * 6/1998 Dozier et al. ..... 439/70
5,820,389 A * 10/1998 Hashiguchi ..... 439/66
6,155,848 A * 12/2000 Lin ..... 439/135
6,196,849 B1 * 3/2001 Goodwin ..... 439/71
6,443,750 B1 * 9/2002 Lemke et al. ..... 439/341

* cited by examiner

*Primary Examiner*—Ross Gushi

(57) ABSTRACT

An electrical socket is provided for receiving processors requiring only vertical mounting actuation. The socket includes a housing having an array of contacts, and a frame having a bottom surface and a contacting surface. The contacts have a loaded position and an unloaded position. The loaded position corresponds to the placement of a desired vertical load. The housing is slidably mounted to the frame. The contacting surface is located such that a processor abuts the contacting surface when the contacts are in the loaded position due to the placement of a processor and the bottom surface of the frame abuts a flat surface, such as a circuit board to which the socket is mounted.

20 Claims, 6 Drawing Sheets

SURFACE MOUNT TECHNOLOGY LAND GRID ARRAY SOCKET

BACKGROUND OF THE INVENTION

Certain embodiments of the present invention generally relate to a socket configured to accept a processor while transferring excess mating force away from more fragile components such as solder balls and maintaining a desired biasing force on contacts of the processor.

Pin grid array (PGA) sockets are used to accept electronic packages on printed circuit boards. PGA sockets facilitate electrical communication between a large number of pins on processors and electrical components to which the PGA sockets are mounted (such as circuit boards). PGA sockets may utilize a cover that is slidably movable on a base between open and closed positions. The sliding movement may be actuated, for example, by a lever. The cover has a hole array configured to match a pin array on an electronic package. Similarly, the base has an array of pin receiving chambers configured to accept the pin array of the electronic package. The electronic package is mated to the socket by first placing the electronic package such that its pins penetrate the holes of the cover. With the cover in the open position, the pins penetrate through the holes of the cover into the pin receiving chambers of the base, but are not electrically connected to the pin receiving chambers of the base. When the cover is slid to the closed position, the pins become electrically connected to the base via the pin receiving chambers. This PGA base and cover arrangement, however, requires use of a mechanism, such as a lever assembly, thereby introducing excess parts and manufacturing cost. The PGA base and cover arrangement also requires additional space as the contacts must be able to move within the pin receiving chambers. These drawbacks are especially troublesome in applications where space is at a premium, such as on motherboards for desktop and laptop computers.

Consequently, land grid array (LGA) sockets have been developed which require only vertical compression to allow a processor and circuit board to electrically communicate. The LGA sockets do not require the lever mechanism, and can be used in applications with more stringent space requirements. LGA sockets, however, require a vertical compression force to be continuously applied to the processor to maintain proper communication between the processor and the circuit board. The applied vertical compressive force may become excessive and damage the socket components if not closely controlled. Hence, LGA sockets can not use low cost mounting techniques such as the use of solder balls, and in addition require expensive materials such as gold plated pads on the motherboards to be used.

A need exists for an improved LGA socket to overcome the above-noted and other disadvantages of conventional PGA and LGA sockets.

BRIEF SUMMARY OF THE INVENTION

At least one embodiment is provided that includes a socket for receiving processors that use vertical mounting actuation to securely engage processor contacts. The socket includes an opening for receiving a processor, a bottom surface, and an array of contacts having a first position and a second position. The opening extends from an upper surface of the socket and terminates at a shelf. A first contact position is defined corresponding to an absence of load on the contacts, and a second contact position is defined corresponding to the placement of a desired vertical load on the contacts. The shelf is substantially parallel to the bottom surface and spaced from the bottom surface a distance corresponding to a distance between the first and second positions of the contacts.

The socket may also include an array of holes that receive the contacts. Each contact may include a solder ball at one end for mounting the contacts to a secondary structure, such as the mother board. Each contact may include a resiliently flexible contact arm at one end and the solder ball at the opposite end. The vertical distance from the base of the solder ball to the top of the contact arm defines the first and second positions of the contacts.

A cover that is removably mounted to the socket for handling the socket and protecting the contact arms during shipping may also be provided.

At least one embodiment provides a vertical mounting actuation socket for receiving processors. The socket includes a housing having an array of contacts, and a frame having a bottom surface and a contacting surface. The contacts have a loaded position and an unloaded position. When in the loaded position, the contacts are placed under a desired vertical load. The housing is slidably mounted to the frame. The contacting surface of the frame is located such that when a processor is loaded onto the contacting surface, the contacts are in the loaded position and the bottom surface of the frame abuts a flat surface.

The housing may be interferably slidably mounted to the frame. In this regard, a force is applied to overcome a physical interference between the frame and housing to move the housing relative to the frame. Further, the frame may include an opening to receive the housing. One of the frame and housing includes a key, and the other of the frame and housing includes a keyway corresponding to the key for slidably mounting the housing to the frame.

The frame may include a first opening extending from the bottom surface and a second opening extending from a top surface of the frame. The first opening receives the housing, and the second opening receives a processor. The first and second openings are joined by a shelf that is substantially parallel to the bottom surface and spaced from the bottom surface a distance corresponding to the loaded position of the contacts.

At least one embodiment provides an electrical system including a circuit board, a processor having a first contacting surface, and a socket mounted to the circuit board. The socket receives the processor and facilitates electrical communication between the circuit board and the processor. The socket includes a housing having an array of contacts and frame having a bottom surface and a second contacting surface. The housing is slidably mounted to the frame. The contacts have an unloaded position and a loaded position, the loaded position corresponding to the placement of a desired vertical load on the contacts. The second contacting surface of the frame is located such that the first contacting surface of the processor abuts the second contacting surface when the processor abuts and biases the contacts to the loaded position and the bottom surface of the frame abuts the circuit board.

Certain embodiments of the present invention thus provide a socket capable of transferring excess force from vulnerable components. Certain embodiments of the present invention also provide a socket that allows for closer spacing of contacts in an array.

Figure 1:
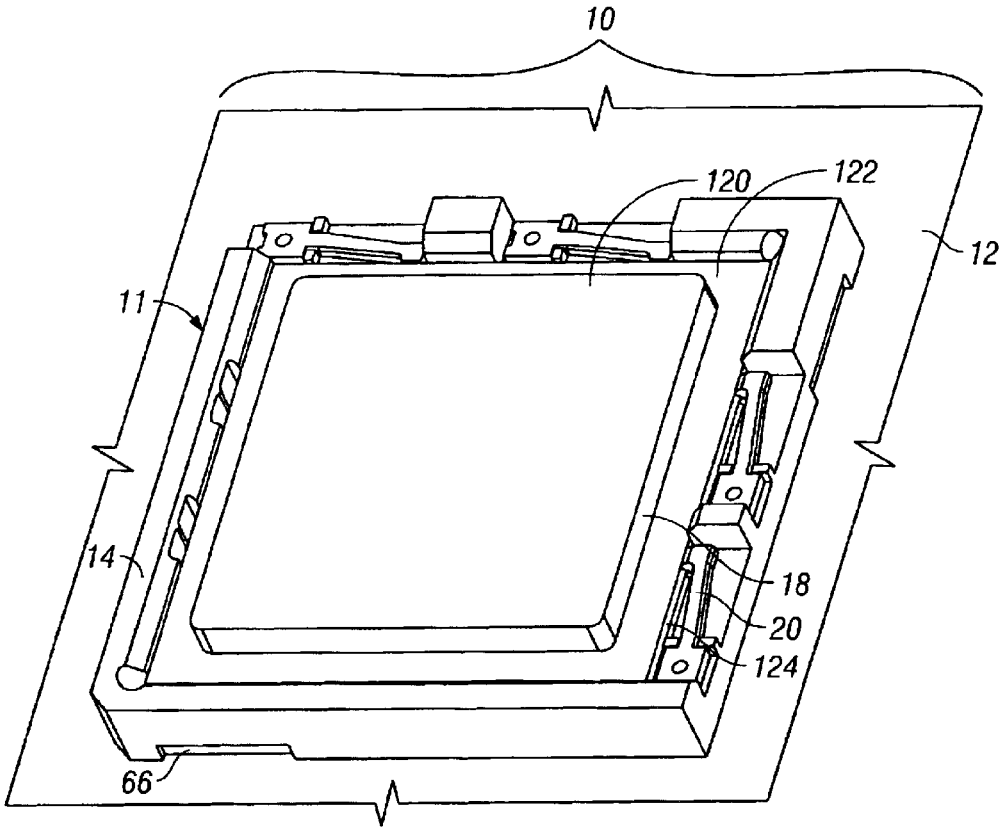
FIG. 1 illustrates a perspective view of an electrical socket system formed in accordance with an embodiment of the present invention.

The foregoing summary, as well as the following detailed description of the preferred embodiments of the present invention, will be better understood when read in conjunction with the appended drawings. For the purpose of illustrating the invention, there is shown in the drawings, embodiments which are presently preferred. It should be understood, however, that the present invention is not limited to the precise arrangements and instrumentality shown in the attached drawings.

DETAILED DESCRIPTION OF THE INVENTION

FIG. 1 illustrates an electrical system 10 including a surface mount land grid array socket 11 formed in accordance with an embodiment of the present invention. The electrical system 10 also includes a circuit board 12 to which the socket 11 is mounted. The circuit board 12 may be, for example, a mother board of a computer. Further, the electrical system 10 includes a processor 18 mounted to the socket 11. The socket 11 includes a frame 14, a housing 16 (see FIG. 2), and bias spring arms 20. The bias spring arms 20 locate and position the processor 18 with respect to the socket 11. The socket 11 facilitates electrical communication between the processor 18 and the circuit board 12.

Figure 2:
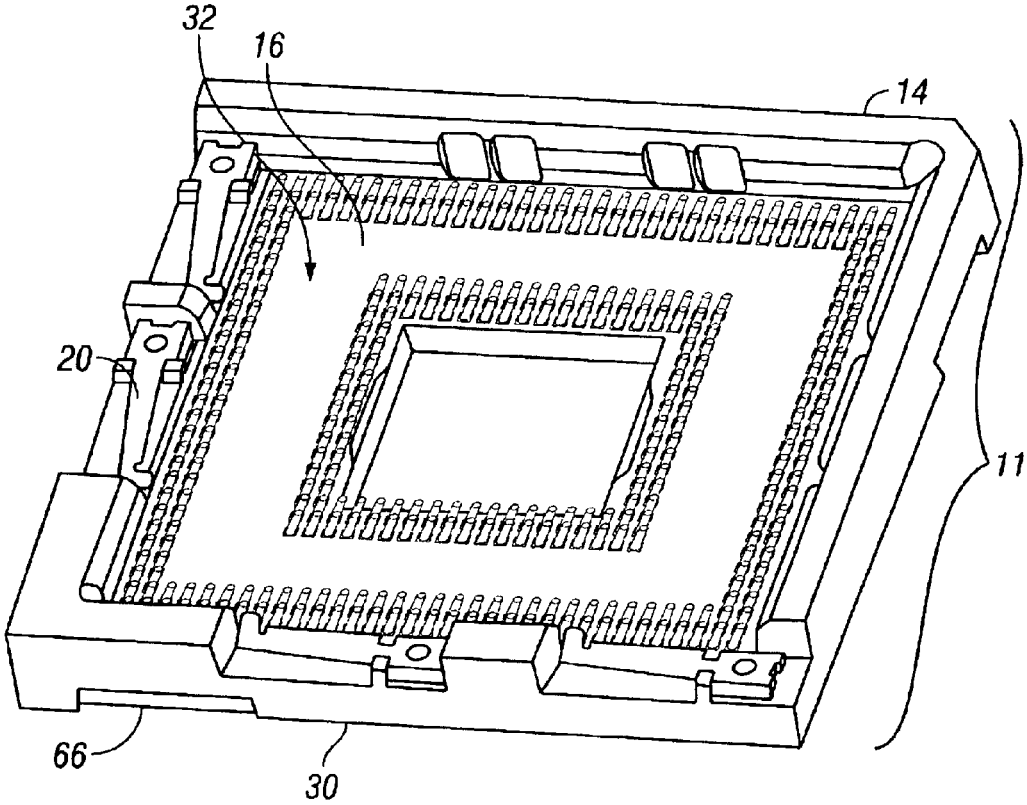
FIG. 2 illustrates a perspective view of a frame formed in accordance with an embodiment of the present invention.

FIGS. 2–6 illustrate various aspects of the frame 14, which may be molded of Stanyl 46HF5040 supplied by DSM. FIG. 2 illustrates a perspective view of the frame 14, with the housing 16 and bias spring arms 20. The frame 14 includes a bottom surface 30 that abuts the circuit board 12 when the socket 11 is mounted to the circuit board 12 and a clamping load is applied. As shown in FIG. 2, the frame 14 includes a housing opening 32 that accepts the housing 16.

Figure 3:
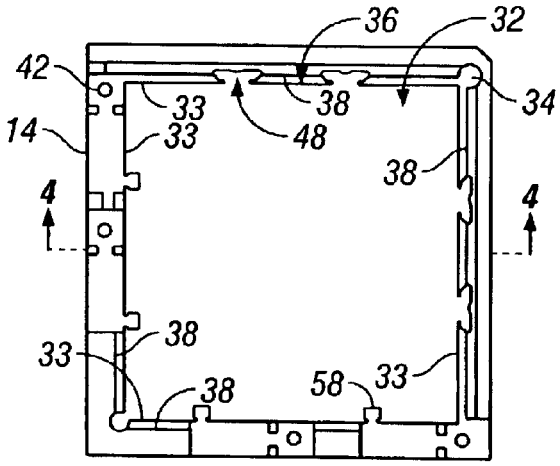
FIG. 3 illustrates a top plan view of a frame formed in accordance with an embodiment of the present invention.
Figure 4:
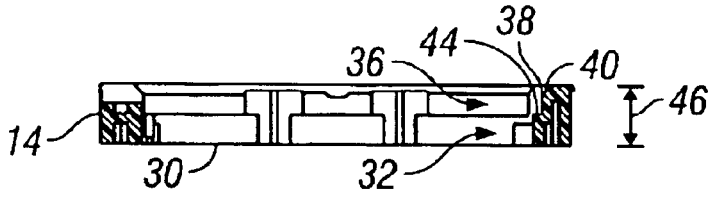
FIG. 4 illustrates a sectional view of the frame taken along line 4—4 of FIG. 3.

FIG. 3 illustrates a plan view of the frame 14, and FIG. 4 illustrates a sectional view of the frame 14 taken along section line 4—4 in FIG. 3. As shown in FIG. 3, the housing opening 32 extends upward from the bottom surface 30 to a shelf 44, and is defined by the four housing opening sides 33. Each housing opening side 33 forms a substantially right angle with its adjacent housing opening sides 33, and the housing opening 32 is sized to accept the housing 16. The frame 14 includes an orientation point 34 located proximal to the juncture of two housing opening sides 33. The orientation point 34 provides a visible cue for orienting the processor 18.

The frame 14 includes a processor opening 36 defined by four processor opening sides 38 extending upward from the shelf 44. The processor opening 36 is generally rectangular, and is sized to accept the processor 18 with a slight clearance. Further, the frame 14 includes a leading edge 40 extending from at least one of the processor opening sides 38 to facilitate easier placement of the processor 18 with the processor opening 36.

As mentioned above, the frame 14 includes a shelf 44 that extends about the perimeter of the frame 14. The shelf 44 is substantially parallel to the bottom surface 30, and is located a shelf height 46 from the bottom surface 30. The shelf 44 joins the housing opening 32 and the processor opening 36, forming an upper boundary for the housing opening 32 and a lower boundary for the processor opening 36. When the electrical system 10 is fully assembled, the processor 18 rests on and abuts against the shelf 44.

The frame 14 also includes bias arm mounting areas 42. The bias spring arms 20 are mounted to the frame 14 at the bias arm mounting areas 42, for example, through a fastener such as a capscrew. The frame 14 also includes frame keyways 48 and frame keys 58 for slidably engaging the housing 16. The frame keyways 48 and frame keys 58 are distributed about the perimeter of the processor opening 36. The frame key 58 extends from a housing opening side 33. The frame keyway 48 extends horizontally outward from a housing opening side 33 and vertically through the housing opening 32.

Figure 5:
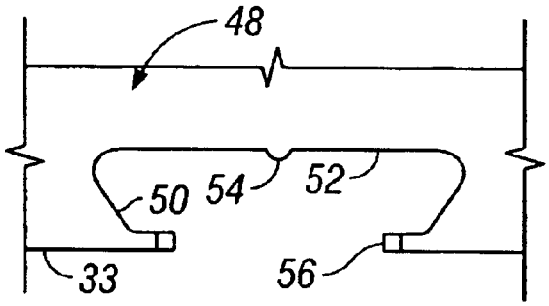
FIG. 5 illustrates an enlarged view of a keyway from the frame of FIG. 3.

As illustrated in FIG. 5, the frame keyway 48 extends back from a throat 56 along sides 50 formed at an obtuse angle to the housing opening side 33. The sides 50 are joined by the back 52 of the frame keyway 48. The back 52 is substantially parallel to the housing opening side 33 from which the keyway 48 extends. Protruding from the back 52 is a crush rib 54. The crush rib 54 provides an interference when a housing key 100 engages the frame keyway 48.

Figure 6:
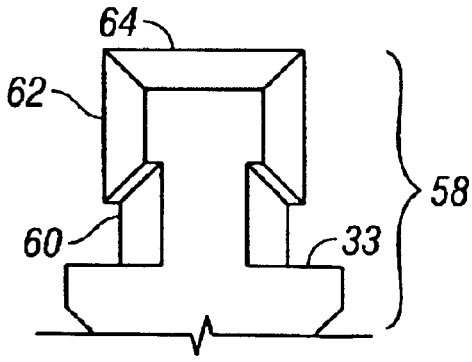
FIG. 6 illustrates an enlarged view of a key from the frame of FIG. 3.

As illustrated in FIG. 6, the frame key 58 includes a neck 60 that extends to the sides 62. The sides 62 are substantially perpendicular to the housing opening side 33 and are joined by the front 64, which is substantially perpendicular to the sides 62.

Referring back to FIGS. 1 and 2, the frame 14 includes cover notches 66. The cover notches 66 extend into the frame 14 and cooperate with a pick and place cover 22 (see FIGS. 14 and 15) to maintain the pick and place cover 22 in place on the frame 14 during shipping of the socket 11 as well as when placing the socket 11 on the circuit board 12.

Figure 7:
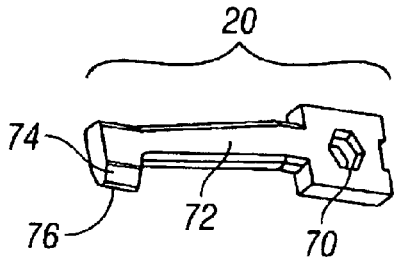
FIG. 7 illustrates a perspective view of a biasing spring arm formed in accordance with an embodiment of the present invention.

FIG. 7 illustrates a perspective view of a bias spring arm 20. The bias spring arm 20 may be made of a plastic, such as Stanyl 46HF5040 supplied by DSM. The bias spring arms 20 are mounted to the frame 14, and are used to assist in the proper positioning of the processor 18 in the socket 11. The bias spring arms 20 help bias a corner of the processor 18 toward the orientation point 34 (see FIGS. 1 and 3). The bias spring arm 20 includes a mounting area 70 that corresponds to and cooperates with the bias arm mounting area 42 on the frame 14 to secure the bias spring arm 20 to the frame 14. The bias spring arm 20 also includes a flex arm 72 extending from near the mounting area 70 toward a contact face 76. The contact face 76 abuts against the side of the processor 14 and urges the processor 14 into proper orientation due to the resilient biasing of the flex arm 72. A leading edge 74 extends from the contact face 76 to facilitate easy placement of the processor 18.

Figure 8:
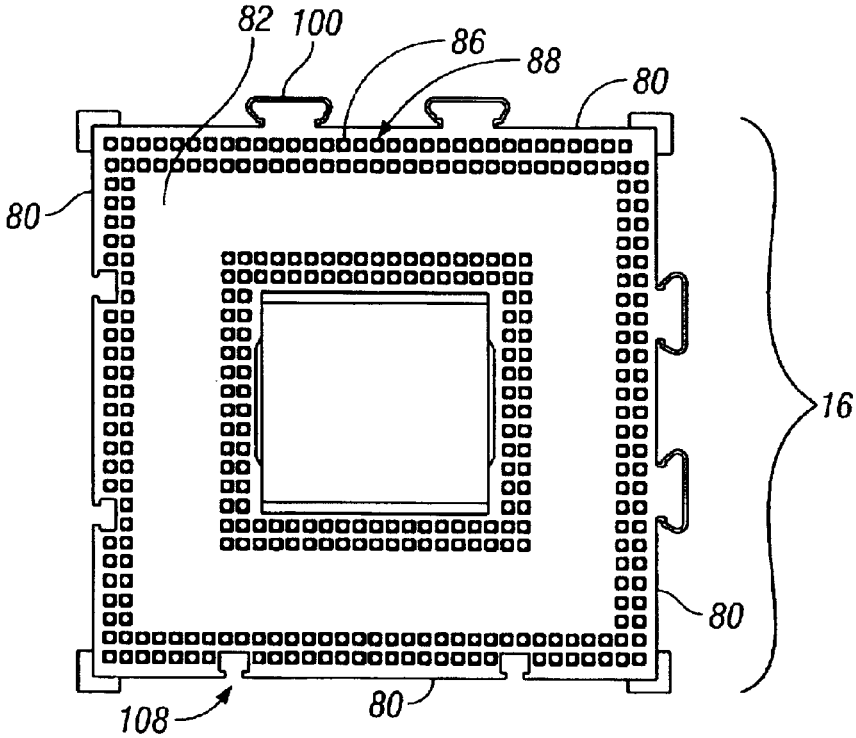
FIG. 8 illustrates a top plan view of a housing formed in accordance with an embodiment of the present invention.
Figure 9:
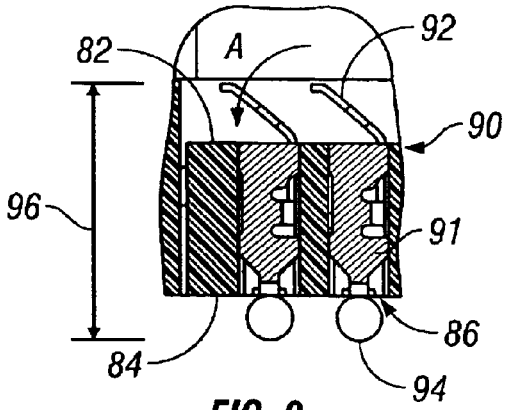
FIG. 9 illustrates a sectional view of the housing of FIG. 8 showing contacts inside of holes.

FIG. 8 illustrates a plan view of the housing 16, which may be made of a plastic, such as Titan LG441 supplied by Eastman Chemical. The perimeter of the housing 16 is defined by sides 80. Each side 80 is substantially perpendicular to its adjacent sides 80. The sides 80 join a top surface 82 and a bottom surface 84 (FIG. 9). The top surface 82 and bottom surface 84 are substantially parallel to each other and perpendicular to the sides 80.

The housing 16 includes holes 86 arranged in a hole array 88. The hole array 88 of the illustrated embodiment includes 735 holes 86, not all of which are shown for clarity. The holes 86 extend through the housing 16 and are sized to accept contacts 90 (see FIG. 9) before becoming fixed in the holes 86. The hole array 88 corresponds to contact arrays on the processor 18 and the circuit board 12, and the contacts 90 provide paths for electrical communication between the processor 18 and the circuit board 12.

FIG. 9 illustrates the contacts 90 when positioned in the holes 86. Each hole 86 accepts a contact 90 that includes a contact arm 92 and a solder ball 94 located at opposite ends of a contact base 91. The holes 86 are sized to properly align, secure, and position the contacts 90 in the desired location. The contact arm 92 extends from the top surface 82 of the housing 16. The contact 90 has an unloaded contact height 96 measured from the end of the solder ball 94 to the tip of the contact arm 92 when unloaded. When the processor 18 is properly positioned in the socket 11 and a desired clamping load is applied, the contacts 90 will have a loaded contact height (not shown) that is less than the unloaded contact height 96. At the loaded contact height, the resilient biasing of the contact arms 92 result in a contact force between the contacts 90 and the processor 18. The contacts 90 are selected to provide geometry to meet the impedance, inductance, and capacitance requirements of a specified application. As shown in FIG. 9, each contact 90 also includes a solder ball 94 that extends beneath the bottom surface 84. The solder balls 94 are used for mounting the housing 16 to the circuit board 12 and to allow electrical communication between the contacts 90 and the circuit board 12. The solder balls 94, for example, may be selected to accommodate either SnPb or Pb free processing. After solder reflow, the solder balls 94 are more oval in shape than shown in FIG. 9.

Figure 10:
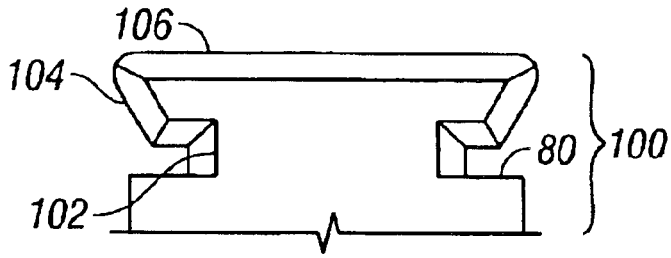
FIG. 10 illustrates an enlarged view of a key from the housing of FIG. 8.

With reference again to FIG. 8, the housing 16 also includes housing keys 100 and housing keyways 108 for slidably engaging the frame 14. FIG. 10 illustrates a housing key 100. The housing key 100 slidably engages the frame keyway 48. The housing key 100 extends from a side 80 of housing 16. The housing key 100 includes a neck 102 that meets sides 104 that extend away from the neck 102 at an obtuse angle. The sides 104 are joined by the front 106, which is substantially parallel to the side 80 from which the housing key 100 extends. The neck 102 and sides 104 are sized to provide a small clearance from the throat 56 and sides 50 of the frame keyway 48. There is an interference however between the crush rib 54 and the front 106. This interference results in a force being required to overcome the interference to slide the housing 16 within the frame 14. The housing key 100 and frame keyway 48 are sized with respect to each other in light of the materials used for the frame 14 and housing 16 to provide an appropriate required force.

Figure 11:
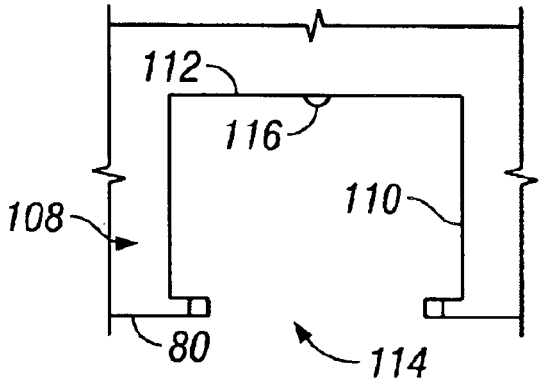
FIG. 11 illustrates an enlarged view of a keyway from the housing of FIG. 8.

FIG. 11 illustrates a housing keyway 108 that slidably engages frame key 58. The housing keyway 108 extends from a side 80 and from the top surface 82 to the bottom surface 84 of the housing 16. The housing keyway 108 includes a throat 114 that leads to sides 110. The sides 110 of the housing keyway 108 are substantially perpendicular to the side 80 of the housing 16 from which the housing keyway 108 extends. A back 112 that is substantially perpendicular to the sides 110 join the sides 110. The housing keyway includes a crush rib 116 that extends from the back 112. The throat 114 and the sides 110 are sized to provide a small clearance from the neck 60 and sides 62 of the frame key 58. However, the crush rib 116 provides an interference with the front 64 of the frame key 58, thereby requiring a force to slide the housing 16 within the frame 14. As above, the frame key 58 and housing keyway 108 are sized with respect to each other to provide an appropriate required force.

Figure 13:
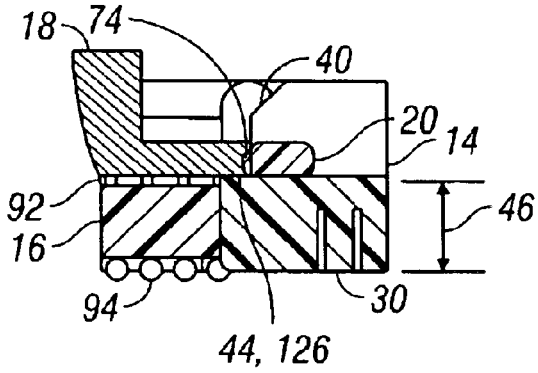
FIG. 13 illustrates a sectional view of a housing and frame formed in accordance with an embodiment of the present invention.

Returning to FIG. 1, the processor 18 includes a top portion 120 and a bottom portion 122 (see FIG. 13). Sides 124 bound the bottom portion 122, and the bottom portion includes a bottom surface 126. The bottom portion 122 is accepted by the processor opening 36 of the frame 14.

Figure 12:
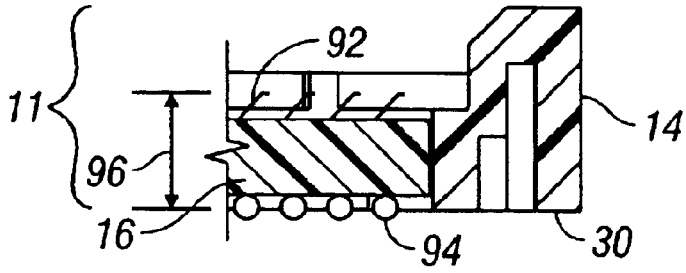
FIG. 12 illustrates a sectional view of a housing and frame formed in accordance with an embodiment of the present invention.

The assembly of the electrical system will now be described with particular reference to FIGS. 12–13. FIG. 12 illustrates a sectional view of the socket 11 before the housing 16 is soldered to the circuit board 12. As shown, the housing 16 is lowered into the housing opening 32 of the frame 14 such that the above described keys and keyways (the housing key 100 and frame keyway 48, and frame key 58 and housing keyway 108) slidably engage each other and the solder balls 94 extend beneath the bottom surface 30 of the frame 14 by a predefined clearance to facilitate soldering the solder balls 94 to the circuit board 12. The contact arms 92 extend upward by the unloaded contact height 96. After the socket 11, with the frame 14 and housing 16 positioned as above described, is oriented and placed on the circuit board 12, the housing 16 may be soldered to the circuit board 12. The solder balls 94 will no longer have the round shape illustrated after solder reflow.

Next, the processor 18 may be placed as illustrated in FIG. 13. The processor 18 encounters the leading edge 74 of the biasing spring arm 20 and/or the leading edge 40 of the processor opening 36 of the frame 14. As the processor 18 is lowered, the biasing spring arms 20 will help properly orient the processor 18 with respect to the hole array 88 of the housing 16. Once the processor 18 is placed within the processor opening 36, a clamping mechanism (not shown) may be used to force the processor 18 down into the proper position and provide the desired biasing force on the contact arms 92. The clamping mechanism may also include a heat sink. As the processor 18 is lowered, the contact arms 92 are flexed in the direction of arrow A in FIG. 9. Also, the bottom surface 126 of the processor 18 will encounter the shelf 44 of the frame 14. FIG. 13 illustrates the condition where the processor 18 first encounters the shelf 44 as the processor 18 is urged downward. A further applied clamping force will bias the contact arms 92 and simultaneously urge the frame 14 downward until the bottom surface 30 of the frame 14 abuts against the circuit board 12. Any clamping force applied to the processor 18 after the frame 14 is against the circuit board 12 will not result in any further biasing of the contact arms 92 beyond the desired position, or loaded position. Rather, the force will be transferred to the frame 14 and circuit board 12. Thus, the force seen by the solder balls 94 is controlled and limited to a predetermined level. Thus, the contact arms 92 are not biased beyond the desired position.

The shelf height 46 is sized to allow the contact arms 92 to be biased to the desired loaded position and no more. This is accomplished by setting the shelf height 46 equal to the vertical distance from the bottom of the solder balls 94 (after reflow) to the tip of the contact arms 92 when the contact arms 92 are loaded by a desired amount. By way of example, the illustrated embodiment is intended for use with a clamping system that provides 100 pounds of clamping force. By way of example, the keys and keyways of the housing 16 and frame 14 are sized such that approximately 35 pounds of force are used to slide the housing 16 and frame 14 with respect to each other. By way of example, the force used to bias all of the contact arms 92 of the illustrated embodiment may be 65 pounds. Thus, the 100 pounds is sufficient to move the frame 14 toward the circuit board 12 and properly bias the contact arms 92. Any excess force applied will not damage the solder balls 94 or improperly position the contact arms 92 once the frame 14 abuts the circuit board 12, thereby protecting those components from damage and providing proper electrical communication. The ability of the frame 14 and housing 16 to move relative to one another helps account for potential variability in the height of the solder balls 94 after reflow while maintaining the force on the contacts 90 near the desired level at the loaded position.

Figure 14:
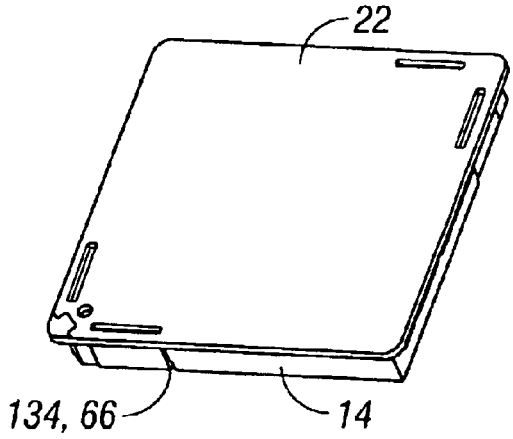
FIG. 14 illustrates a perspective view of a cover mounted to a frame formed in accordance with an embodiment of the present invention.
Figure 15:
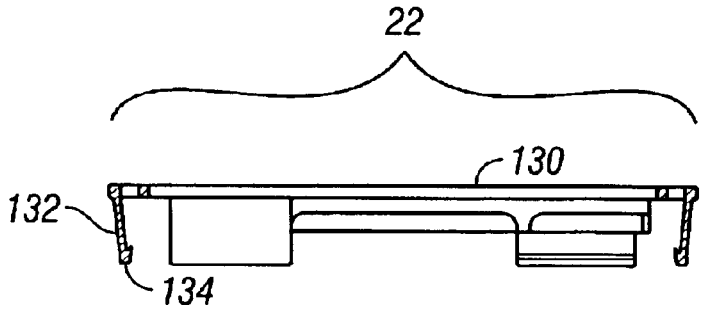
FIG. 15 illustrates an elevation view of a cover formed in accordance with an embodiment of the present invention.

The electrical system 10 may also include a pick and place cover 22 for shipping as well as positioning the socket 11. FIGS. 14 and 15 illustrate the pick and place cover 22. FIG. 14 illustrates a perspective view of the frame 14 with the pick and place cover 22 in place, and FIG. 15 illustrates a sectional elevation view of the pick and place cover 22 taken along the center of the pick and place cover 22.

The pick and place cover 22, which may be molded from a plastic such as Questra EA535, 30% glass filled syndiotactic polystyrene available from Dow Chemical, includes a top surface 130 and cover arms 132 extending from the top surface 130. The cover arms 132 terminate in retention portions 134 that cooperate with the cover notches 66 of the frame 14 to hold the pick and place cover 22 in place on the frame 14. When the pick and place cover 22 is placed on the frame 14, the cover arms 132 bias outward from the sides of the frame 14 until the retention portions 134 are aligned with the cover notches 66, at which point the cover arms 132 return to their unbiased position, thereby snappably securing the pick and place cover 22 in place.

For shipping, the housing 16 is slid into the frame 14. The above described interferences for the keys and keyways of the housing 16 and frame 14 keep the housing 16 from sliding out of the frame 14. The pick and place cover 22 is then snapped into place on the frame 14. The pick and place cover 22 provides a convenient surface to grasp either manually or in an automated process, such as with a vacuum at the end of a robotic arm, and also provides protection to the contacts 90 during shipping. To place the socket 11 on a circuit board 12, the socket 22 may be handled by grasping the pick and place cover 22 and positioning appropriately. Once the socket 11 is in place, the pick and place cover 22 may be easily snapped off.

While particular elements, embodiments and applications of the present invention have been shown and described, it will be understood, of course, that the invention is not limited thereto since modifications may be made by those skilled in the art, particularly in light of the foregoing teachings. For example, a different surface other than the bottom surface of the processor may be used to contact the frame, thereby changing the location of the shelf, or using a different contacting surface on the frame to be contacted by the processor. It is therefore contemplated by the appended claims to cover such modifications as incorporate those features which come within the spirit and scope of the invention.

What is claimed is:

1. An electrical socket, comprising:

a frame having a bottom surface configured to abut against a circuit board and having a processor opening opposite said bottom surface and a housing opening adjacent said bottom surface, said processor opening being configured to accept a processor, said frame including sides surrounding said processor opening and surrounding said housing opening, at least one of said sides including a ledge extending parallel to said bottom surface and defining said housing opening, said housing opening smaller than said processor opening and said ledge being spaced a maximum load distance from said bottom surface; and a housing having an array of contacts mounted therein, said housing slidaby received within said frame wherein said contacts extend into said processor opening and beyond said bottom surface, said array of contacts being flexed between loaded and unloaded positions, said maximum load distance defining an amount that said array of contacts are biased when flexed to said loaded position, said slidably mounted housing permitting relative movement of said housing with respect to said frame when said contacts are soldered to a circuit board.

2. The electrical socket of claim 1 further including an array of holes that receive said array of contacts.

3. The electrical socket of claim 1 wherein said contacts include a solder ball at one end of said contacts for mounting said contacts.

4. The electrical socket of claim 1 wherein said contacts include a resiliently flexible contact arm and a solder ball at opposite ends of said contacts, and said first and second positions are defined by the vertical distance from the base of said solder ball to the top of said contact arm.

5. The electrical socket of claim 1 further including biasing arms mounted to said electrical socket, said biasing arms being resiliently biased and providing an orienting force when a processor is placed in said electrical socket.

6. The electrical socket of claim 1 further including a cover removably mounted to said electrical socket for handling said electrical socket.

7. An electrical socket, comprising:

a housing having an array of contacts, said contacts being flexed between an unloaded position and a loaded position; and a frame having a bottom surface and a contacting surface, said housing being slidably mounted to said frame, said contacting surface being spaced a maximum load distance from said bottom surface, said maximum load distance defining an amount that said array of contacts are biased when flexed to said loaded position, said contacting surface located such that a processor abuts said contacting surface when said contacts are in said loaded position, said bottom surface of said frame being configured to abut a circuit board;

wherein said slidably mounted housing is movable relative to said frame to approximately maintain a desired force on said contacts in said loaded position despite variability in solder height when connecting said contacts to said circuit board.

8. The electrical socket of claim 7, wherein said housing is interferably slidably mounted to said frame, whereby a force must be applied to overcome a physical interference between said frame and housing to move said housing relative to said frame.

9. The electrical socket of claim 7, wherein said frame includes an opening to receive said housing, one of said frame and housing having a key, and the other of said frame and housing having a keyway corresponding to said key for slidably mounting said housing to said frame.

10. The electrical socket of claim 7, wherein said frame includes a first opening extending from said bottom surface to receive said housing, and a second opening extending from a top surface of said frame to receive a processor, said first and second openings being joined by a shelf that is substantially parallel to said bottom surface and spaced from said bottom surface a distance corresponding to said loaded position of said contacts.

11. The electrical socket of claim 7 further including an array of holes that receive said contacts.

12. The electrical socket of claim 7 wherein said contacts include a solder ball at one end of said contacts for mounting said contacts.

13. The electrical socket of claim 7 wherein said contacts include a resiliently flexible contact arm and a solder ball at opposite ends of said contacts, and said loaded and unloaded positions are defined by the vertical distance from the base of said solder ball to the top of said contact arm.

14. The electrical socket of claim 7 further including biasing arms mounted to said electrical socket, said biasing arms being resiliently biased and providing an orienting force when a processor is placed in said electrical socket.

15. The electrical socket of claim 7 further including a cover removably mountable to said socket for handling said electrical socket.

16. An electrical system comprising:

a circuit board;

a processor having a first contacting surface; and an electrical socket mounted to said circuit board, said socket receiving said processor and facilitating electrical communication between said circuit board and said processor, said electrical socket including a housing having an array of contacts, solder balls for connecting said contacts to said circuit board and a frame having a bottom surface and a second contacting surface, said contacts being flexed between an unloaded position and a loaded position, said housing being slidably mounted to said frame and movable relative to said frame during reflow of said solder balls to account for variability in a height of said solder balls after reflow;

wherein said second contacting surface being spaced a maximum load distance from said bottom surface, said maximum load distance defining an amount that said contacts are biased when flexed to said loaded position, said second contacting surface of said frame located such that said first contacting surface of said processor abuts said second contacting surface when said processor abuts and biases said contacts to said loaded position and said bottom surface of said frame abuts said circuit board.

17. The electrical system of claim 16 wherein said housing is interferably slidably mounted to said frame, whereby a force must be applied to overcome a physical interference between said frame and housing to move said housing relative to said frame.

18. The electrical system of claim 16 wherein said frame includes a first opening extending from said bottom surface to receive said housing, and a second opening extending from a top surface of said frame to receive said processor, said first and second openings being joined by a shelf that is substantially parallel to said bottom surface and spaced from said bottom surface a distance corresponding to said loaded position of said contacts, said second contacting surface including said shelf.

19. The electrical system of claim 16 wherein each of said contacts include a resiliently flexible contact arm at a first end and a solder ball at a second end opposite said first end, and said loaded and unloaded positions are defined by the vertical distance from the base of said solder ball to the top of said contact arm.

20. The electrical system of claim 16 further including a cover removably mountable to said electrical socket for handling said electrical socket.

* * * * *